US006289806B2

(12) United States Patent
Hirano

(10) Patent No.: US 6,289,806 B2
(45) **Date of Patent: *Sep. 18, 2001**

(54) PROCESS FOR PRODUCING SELF-INKING STAMP AND SELF-INKING STAMP

(75) Inventor: Koichi Hirano, Yokohama (JP)

(73) Assignee: Mitsubishi Pencil Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/277,246

(22) Filed: Mar. 26, 1999

(30) Foreign Application Priority Data

Mar. 30, 1998 (JP) ..... 10-084450
Mar. 24, 1999 (JP) ..... 11-079981

(51) Int. Cl.[7] ..... B41K 1/42; B05C 11/00
(52) U.S. Cl. ..... 101/333; 101/334; 118/264
(58) Field of Search ..... 101/104, 105, 101/334, 333; 118/264, 46, 269

(56) References Cited

U.S. PATENT DOCUMENTS 4,881,841 * 11/1989 Irwin ..... 401/195
5,049,432 * 9/1991 Ooms et al. ..... 428/159
5,123,349 * 6/1992 Beaver et al. ..... 101/333
5,271,322 * 12/1993 Palms ..... 101/333
5,623,875 * 4/1997 Perets ..... 101/334
5,735,954 * 4/1998 Zeitler ..... 118/264
5,771,806 * 6/1998 Imamaki ..... 101/333
5,865,892 * 2/1999 Yasoshima ..... 118/264

* cited by examiner

*Primary Examiner*—Kimberly L. Asher
(74) *Attorney, Agent, or Firm*—Darby & Darby

(57) ABSTRACT

A process for producing a self-inking stamp capable of stamping repeatedly by filling ink in a stamp material having a continuous porous structure, wherein the stamp material having a continuous porous structure is provided with an occlusion body having a continuous porous structure and being impregnated with two or more kinds of ink having different functions so as to infiltrate two or more kinds of ink into the stamp material. In the process, there is used an occlusion body having a physical barrier and/or an isolation part which suppresses or inhibits mingling of two or more kinds of ink having different functions, and a self-inking stamp produced by the process.

13 Claims, 6 Drawing Sheets

PROCESS FOR PRODUCING SELF-INKING STAMP AND SELF-INKING STAMP

BACKGROUND OF THE INVENTION

1. Field of the Invention

The present invention relates to a process for producing a self-inking stamp which can be used repeatedly for stamping and a self-inking stamp.

2. Description of the Related Art

Heretofore, there have been known various methods for filling ink in a self-inking stamp, such as dipping a stamp material in ink, dropping ink from the rear side of the stamp material and the like. Among them, there is known a method for producing the stamp in which ink is infiltrated into the stamp material by making an occlusion body impregnated with ink abut against a stamp material having a continuous porous structure.

When ink is filled in the self-inking stamp with any of the above-mentioned method, however, only one kind of ink can be filled in one stamp material, thus having a problem that a stamp of a plurality of colors or a stamp prepared by filling a plurality of inks having different functions in one stamp material cannot be produced.

To solve such a problem, there have been a stamp which can form an imprint in a plurality of colors by a single stamping, by combining a plurality of stamp materials, each of which has one kind of ink in one holder, and a stamp capable of forming an imprint in a plurality of colors by a single stamping, by filling one and single occlusion body with a plurality of colors of ink and by making the occlusion body abut against a stamp material to fill the stamp material with the plurality of ink.

According to the aforementioned means, however, since joints of the plurality of stamp materials are left due to the structure of the stamp, a sense of unity is lacking. Further, there are also problems that when a joint of the plurality of stamp materials is between a continuous pattern, a joint appears in the imprint, and that it is difficult to fill the stamp with ink so as to form color areas in the imprint as desired.

SUMMARY OF THE INVENTION

It is an object of the present invention to provide a self-inking stamp capable of forming an imprint comprising plural kinds of ink by a single stamping.

It is another object of the present invention to provide a self-inking stamp capable of forming an imprint comprising plural kinds of ink without any break due to a boundary by a desired color combination.

It is a further object of the present invention to provide a process for producing the above-mentioned self-inking stamp.

In one aspect, the present invention provides a process for producing a self-inking stamp capable of stamping repeatedly by filling ink in a stamp material having a continuous porous structure, wherein the stamp material having a continuous porous structure is provided with an occlusion body having a continuous porous structure and impregnated with two or more kinds of ink having different functions so as to infiltrate two or more kinds of ink into the stamp material, the occlusion body having a physical barrier and/or an isolation part which suppresses or inhibits mingling of two or more kinds of ink having different functions.

In another aspect, the present invention provides a self-inking stamp produced by the above-mentioned process.

In a further aspect, the present invention provides a self-inking stamp capable of stamping repeatedly by filling ink in a stamp material having a continuous porous structure, wherein the stamp material is provided with an occlusion body having a physical barrier and/or an isolation part which suppresses or inhibits mingling of two or more kinds of ink having different functions.

DETAILED DESCRIPTION OF THE PREFERRED EMBODIMENTS

Figure 1:
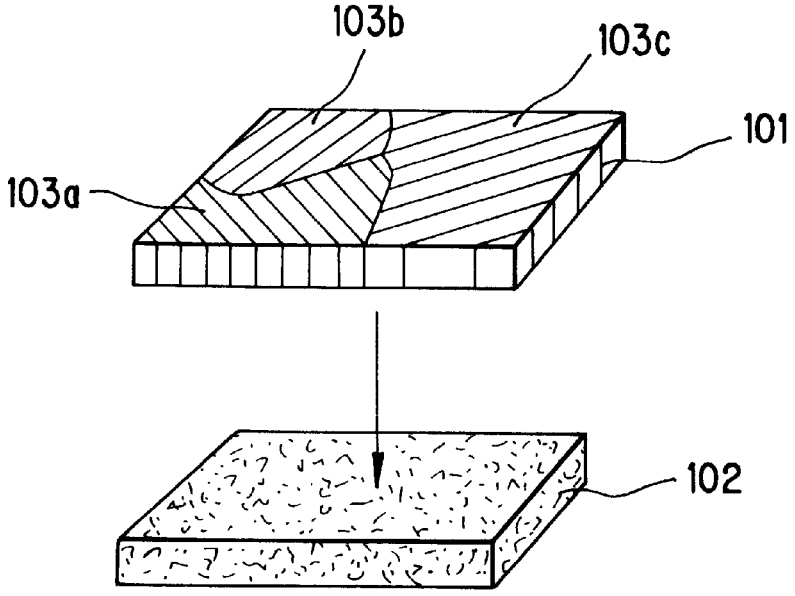
FIG. 1 PRIOR ART
FIG. 1 is an exploded oblique view showing one example of a filling member used in the filling process of the prior art, based on which the process for producing a self-inking stamp of the present invention has been achieved.

The embodiments of the present invention will now be explained below in detail.

The present invention provides a process for producing a self-inking stamp capable of stamping repeatedly by filling ink in a stamp material having a continuous porous structure, wherein the stamp material having a continuous porous structure is provided with an occlusion body having a continuous porous structure and impregnated with two or more kinds of ink having different functions so as to infiltrate two or more kinds of ink into the stamp material, the occlusion body having a physical barrier and/or an isolation part which suppresses or inhibits mingling of two or more kinds of ink having different functions.

The present invention also provides a self-inking stamp produced by the above-mentioned process.

The present invention further provides a self-inking stamp capable of stamping repeatedly by filling ink in a stamp material having a continuous porous structure, wherein the stamp material is provided with an occlusion body having a physical barrier and/or an isolation part which suppresses or inhibits mingling of two or more kinds of ink having different functions.

In the present invention, the separation part in the occlusion body, that is, a physical barrier and/or an isolation part suppresses or inhibits mingling of two or more kinds of ink having different functions, for example, there may be employed dividing the occlusion body, providing a slit, providing a recess portion, or the like. Moreover, as for the physical barrier, there may be used a matter for preventing the flow of ink, for example, a filler.

Therefore, in the present invention, an occlusion body provided with such a physical barrier and/or an isolation part may be used.

In the present invention, as a method for fitting the stamp material having a continuous porous structure with an occlusion body having a continuous porous structure, impregnated with two or more kinds of ink having different functions, for example, abutment, pressing contact, or the like may be mentioned.

According to the present invention, the combination of the stamp material having a continuous porous structure and the occlusion body having a continuous porous structure is selected such that the ink holding force of the occlusion body is weaker than that of the stamp material. The selection test may be conducted by making an occlusion body abut against a stamp material where both of them are filled with an ink at the same filling rate less than 100% and kept for a sufficient length of time. Then, the amount of the transferred ink for each of them is measured, and a combination is selected, as a preferable one, in which a part of the ink filled in the occlusion body has transferred to the stamp material. That is, in such a case as above, the ink holding force of the occlusion body is weaker than that of the stamp material. As far as such relation between the ink holding forces can be satisfied, any materials used in this technical field may be employed.

As described above, by setting the ink holding force of the occlusion body to be weaker than that of the stamp material, the stamp material acts to suck the ink filled in the occlusion body, hence, supply of ink to the stamp material can be performed more quickly.

As the material used for the stamp material, there may be mentioned, for example, a sponge rubber having a porosity of from 30 to 80%, and a spring hardness of from 5 to 65, and examples of the material are acrylic rubber, butyl rubber, acrylonitrile-butadiene rubber, ethylene-propylene rubber, ethylene-butylene rubber, vinyl chloride rubber, EPDM (ethylene-propylene-diene copolymer), polyethylene and the like.

The material for the occlusion body includes for example, a sponge rubber, plastic, ceramics, a metal sintered body or the like, and the material is selected from the one having a porosity of from 30 to 95%.

As a specific example of the material used for the occlusion body, there can be mentioned, for example, acrylic rubber, butyl rubber, acrylonitrile-butadiene rubber, ethylene-propylene rubber, ethylene-butylene rubber, vinyl chloride rubber, EPDM (ethylene-propylene-diene copolymer), PVF [poly(vinyl formal)] and the like.

As the inks having different functions used in the present invention, inks having different colors or different properties may be used. As a coloring material for the ink, either pigment or dye may be used, or both of them may be combined, but when mingling of colors of plural kinds of ink filled in the produced stamp is to be suppressed for a long period of time, it is preferred to use a pigment as a main component, and a dye may be added as an auxiliary color. However, when stress is not put on the effect of suppressing mingling of colors, a dye may be used singly.

Moreover, as pigments or dyes, pigments and dyes normally used for writing instruments can be used.

As pigments, inorganic pigments and organic pigments, such as titanium oxide, carbon black, phthalocyanine types, azo types, anthraquinone types, quinacridone types and the like may be directly used, or a processed pigments obtained by surface-modifying said pigments by resins or surfactants also may be used.

As dyes, there may be used not only basic dyes, acid dyes, direct dyes and the like, but also solubilized dyes, microcapsulated dyes and the like. As specific examples of the dyes, for example, there can be mentioned "Varifast Black #1802", "Varifast Black #1805", "Varifast Black #3820", "Varifast Violet #1701", "Varifast Yellow AUM", "Varifast Yellow #3104" and the like manufactured by Orient Chemical Ind. Ltd., "Spilon Violet C-RH", "Spilon Black CMH special", "Spilon Yellow C-GNH", "Spilon Orange GRH", "Spilon Red BEH" and the like manufactured by Hodogaya Chemical Co., Ltd., auramine, rhodamine and the like.

The amount of coloring materials incorporated in ink is not particularly limited, and may be any amount depending upon the solubility or dispersion force of the ink , or any amount appropriate for a desired hue or density. However, the amount deeply relates to the density of the imprint and discharge amount of the ink, and if the amount incorporated becomes too large, the density of the imprint becomes high, but the discharge amount becomes less to shorten the life of the self-inking stamp. On the contrary, if the amount incorporated becomes too small, the life of the self-inking stamp becomes long, but coloring of the imprint is not good. As the content of coloring materials incorporated in ink is properly selected from the range of, in general, from 3 to 20% by weight based on the weight of the total amount of ink.

When the ink is prepared, a vehicle is generally used. As the vehicles, there can be mentioned those comprising one kind of disperse resin and one or more kinds of solvents.

The disperse resin includes, for example, poly(vinyl butyral) resin, ethyl cellulose resin, and the like.

As the solvents, there can be mentioned glycol such as octylene glycol and the like, polyalkylene glycol such as polyethylene glycol, polypropylene glycol, and the like, glycol ethers such as diethylene glycol monobutyl ether and the like, fatty acid esters such as ethylene glycol monoricinoleate, propylene glycol monoricinoleate, and the like, castor oil fatty acid methyl ester, polyoxyethylene glycol oleate monoether, polyoxypropylene glycol monoether, and the like.

In the present invention, the solvent constituting the above-mentioned vehicle preferably has a vapor pressure of not higher than 0.1 mmHg/25° C., in view of the volatility at ambient temperature, thereby acceptable stamping properties can be exerted. Moreover, the viscosity of the ink comprising the above-mentioned vehicle and ink is desired to be generally in a range of from 5 to 3000 mPa·s, preferably from 30 to 2500 mPa·s, from the reasons described below. That is to say, the ink having the viscosity in the range described above shows acceptable results in the imprint type-holding property and the non-mingling property of the ink. If the viscosity is lower than the above described range, the ink filling time is short, but the discharge amount of ink at the time of stamping is also large, and blur of the imprint becomes large, hence a clear imprint cannot be obtained. Moreover, if the viscosity is higher than the above described range, filling of ink becomes difficult, as well as the followability of ink at the time of continuous stamping becomes poor, and tackiness becomes large at the time of stamping, causing an ink threading phenomenon.

Components other than those described above may be incorporated in the ink used in the present invention, according to need, so far as the properties of the self-inking stamp is not hindered. As components which can be incorporated, for example, there can be mentioned resins, surfactants, antiseptics, dispersing assistants or the like.

The self-inking stamp of the present invention is characterized in that an occlusion body provided with a physical barrier and/or an isolation part which suppresses or inhibits mingling of two or more kinds of ink having different functions is used. Thereby, such distinguished effects can be exerted that an imprint comprising plural kinds of ink can be formed with one stamping, that there is no break due to a boundary in the imprint comprising plural kinds of ink, showing a very natural impression, and that the filling areas of the plural kinds of ink are faithful to the preliminary desired areas.

The self-inking stamp of the present invention has a stamp material in which the respective desired areas are filled with the respective kinds of ink having different functions from each other, and the stamp material is composed of one material member. The occlusion body capable of filling the stamp material with the above-mentioned two or more kinds of ink is provided with a physical barrier and/or an isolation part for suppressing or inhibiting mingling of the two or more kinds of ink, and the physical barrier and/or isolation part divides the occlusion body such that the shapes of the resulting divided portions are similar to the shapes of the desired areas of the stamp material which are to be filled with the kinds of ink, respectively, or the resulting similar shapes are further divided. As a result, the self-inking stamp having the occlusion body of the present invention can give an imprint having various areas different in ink color by one stamping. The result-imprint composed of areas different in ink color has no break at the boundary between the areas and in addition, the imprint shows a natural impression.

It is easy here to fill the stamp material simply with two or more kinds of ink having different functions, but it is difficult to fill the respective desired areas of the stamp material with the respective kinds of ink.

Thus, according to the present invention, the occlusion body is provided with a physical barrier and/or an isolation part for suppressing or inhibiting the mingling of two or more kinds of ink having different functions from each other. Thereby, the respective desired areas of the stamp material can be filled with the respective kinds of ink even by using conventional filling procedure such as dropping the respective inks to a surface of the occlusion body opposite to the surface contacting with the stamp material, or in the case of the occlusion body being divided, bringing each divided occlusion part dipped in each corresponding ink into contact with the rear surface of the stamp material.

According to the conventional self-inking stamps, the pore size of the occlusion body is larger than that of the stamp material so as to transfer the ink smoothly from the occlusion body to the stamp material by utilizing the difference in ink holding force between the occlusion body and the stamp material. However, in the occlusion body, two or more kinds of ink are liable to mingle with each other.

Therefore, according to the present invention, the occlusion body is provided with a physical barrier and/or an isolation part for the purpose of suppressing and inhibiting the mingling of two or more kinds of ink having different functions from each other, the above-mentioned effects can he obtained.

In addition, in the manufacturing procedure for the self-inking stamp, for example, a step of filling the stamp material with ink by contacting the occlusion body with the stamp material and a step of feeding ink to the occlusion body are repeated. That is, filling the stamp material with ink and supplying ink to the occlusion body are repeatedly carried out in said one and the same occlusion body. Mingling of two or more kinds of ink having different functions from each other occurs to a great extent when fluctuation or flowing and moving is the most vigorous, that is, when filling with ink. When two or more kinds of ink have been incorporated into the body or material, the ink can neither flow nor move so much, thereby the mingling speed becomes so slow that there is no problem if filling with ink is effected only once. However, if filling with ink is carried out repeatedly, the mingling of these two or more kinds of ink becomes problematic gradually.

However, according to the present invention, the occlusion body is provided with a physical barrier and/or an isolation part so as to suppress or inhibit mingling of two or more kinds of ink having different functions, thereby it can be repeatedly carried out efficiently to fill the stamp material with the two or more kinds of ink.

The embodiments of the present invention will now be explained below with reference to the accompanying drawings.

FIG. 1 is an exploded oblique view showing one example of prior art of a filling member used for a filling method which was a basis of the process for producing a self-inking stamp of the present invention.

An occlusion body 101 is an occlusion body impregnated with plural kinds of ink (103*a*, 103*b*, 103*c*), and by making this occlusion body abut against the stamp material 102, plural kinds of ink in the occlusion body 101 are filled in the stamp material 102. According to this method, it is possible to form a stamping face where one stamping face can be filled with plural kinds of ink, but it is difficult to fill the respective desired areas with the respective kinds of ink, thus the stamping face is only simply filled with plural kinds of ink.

Figure 2:
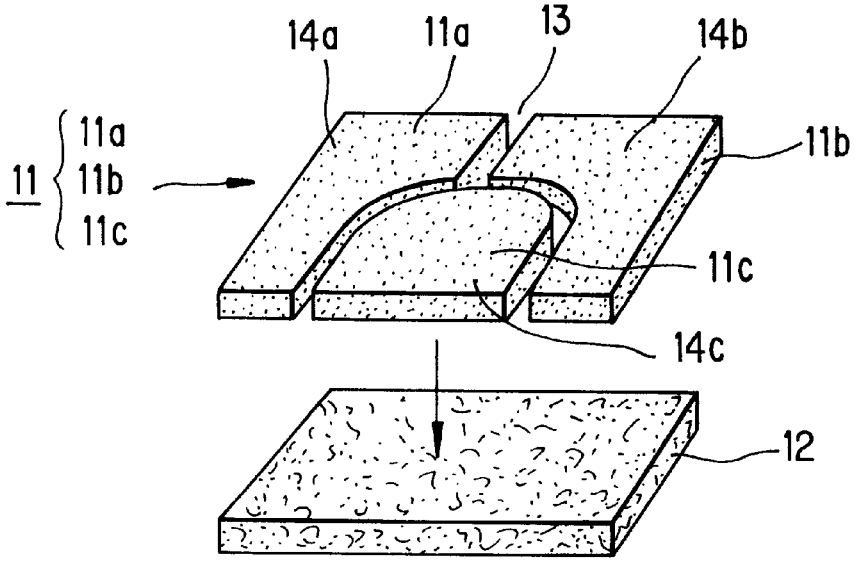
FIG. 2 is an exploded oblique view showing an example of a filling member used in the process for producing a self-inking stamp according to the present invention.

FIG. 2 is an exploded oblique view showing one embodiment of a filling member to be used in the process for producing the self-inking stamp of the present invention. An occlusion body 11 is divided into 11*a* to 11*c* (a dividing part 13), and by making the occlusion body 11 abut against a stamp material 12, the stamp material 12 is filled with different kinds of ink. Here, the divided occlusion bodies

11*a* to 11*c* are impregnated with different kinds of ink 14*a* to 14*c*, respectively. Therefore, the plural kinds of ink do not mingle with each other, and by forming the shape of occlusion bodies 11*a* to 11*c* in desired shapes, the arrangement of ink filled in the stamp material 12 can be finely controlled. Filling of ink into the occlusion body may be effected by impregnation and the like.

Figure 3:
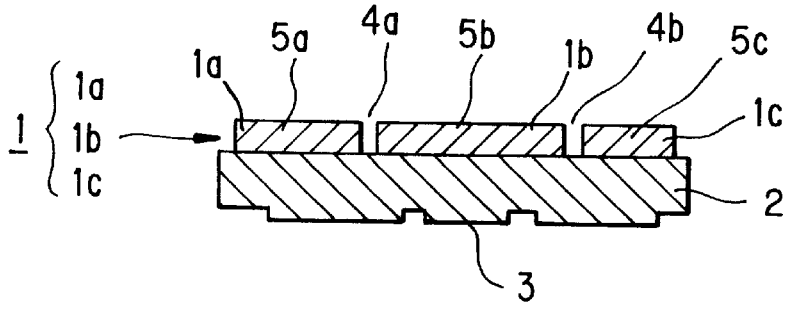
FIG. 3 is a vertical sectional view showing a first embodiment of a process for producing a self-inking stamp according to the present invention.

FIG. 3 is a vertical sectional view showing a first embodiment in accordance with the process for producing the self-inking stamp of the present invention. As shown in FIG. 3, an occlusion body 1 is divided into 1*a* to 1*c* (dividing parts 4*a* and 4*b*), and by making this occlusion body 1 abut against a stamp material 2 from the rear side of a stamping face 3, plural kinds of ink are filled in the stamp material 2. Here, the divided occlusion bodies 1*a* to 1*c* are impregnated with different kinds of ink 5*a* to 5*c*, respectively. Therefore, plural kinds of ink do not mingle with each other, and by forming the shape of occlusion bodies 1*a* to 1*c* in desired shapes, the arrangement of ink filled in the stamp material 2 can be accurately controlled.

Also, at this time, the occlusion bodies are made to abut against the stamp material from the opposite side, i.e., the rear side of the stamping face of the stamp material, the reason is as follows.

The surface side, that is, the stamping face is generally provided with recess and protrusion portions for applying ink selectively onto a forming imprint part, or an exudation portion and an non-exduation portion of the ink, in order to obtain an imprint. Therefore, when ink is fed by making the occlusion body abut against the stamp material from the surface side, there may be a case where ink cannot be fed from the recess portions on the stamping face or from the non-exudation portion of the ink. As a measure for solving this problem, there can be considered a method that protrusion portions corresponding to the recess portions are provided on the occlusion body, but the shape of the occlusion body becomes complicated, resulting in increase of production cost and decrease of productivity. Hence, unless particularly delicate coloration is required, it is desired to feed the ink from the opposite side, that is, the rear side of the stamping face of the stamp material.

As the space away from the occlusion body adjacent to each divided occlusion body (dividing parts 4*a* and 4*b*), it is not particularly limited, so far as plural kinds of ink in the occlusion body do not mingle with each other, and the arrangement of ink to be filled in the stamp material can be finely controlled. The space is properly selected from the range of, in general, not less than 0.5 mm, preferably from 0.5 to 2.0 mm.

Figure 4:
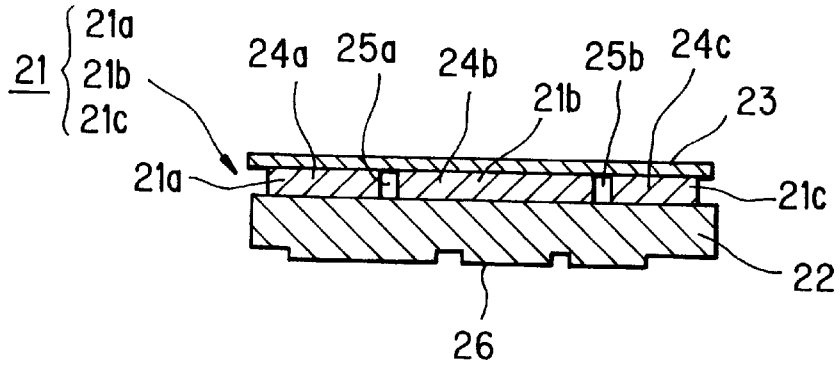
FIG. 4 is a vertical sectional view showing a second embodiment of a process for producing a self-inking stamp according to the present invention.

FIG. 4 is a vertical sectional view showing a second embodiment in accordance with the process for producing the self-inking stamp of the present invention. An occlusion body 21 is divided into 21*a* to 21*c* (dividing parts 25*a* and 25*b*), and by making this occlusion body 21 abut against a stamp material 22 from the rear side of a stamping face 26, inks are filled in the stamp material 22. Here, divided occlusion bodies 21*a* to 21*c* are impregnated with different kinds of ink 24*a* to 24*c*, respectively. Therefore, plural kinds of ink do not mingle with each other, and by forming the shape of each of occlusion bodies 21*a* to 21*c* in each desired shape, the arrangement of ink filled in the stamp material 22 can be accurately controlled. Also, these occlusion bodies 21*a* to 21*c* are pressed into contact with the stamp material 22 from the rear side of the face contacting with the stamp material 22 by a weight 23. Therefore, since the occlusion bodies 21*a* to 21*c* are pressed into contact with the stamp material 22 by the weight 23, adhesion of said occlusion bodies 21*a* to 21*c* and the stamp material 22 is held, and an ideal contact area can be obtained, enabling smooth filling.

As the weight, it is not particularly limited, and any weight generally used as a weight in this field may be used. Also, the material of the weight is not particularly specified, and for example, plastic, metal and the like can be used, and it is selected from materials which are not damaged due to swelling, cracks, rust and the like, depending upon the ink used. Furthermore, the weight used generally has also a function of a holder for holding the occlusion body, or has a shape attachable/detachable to/from the occlusion body or a shape loadable thereto, hence the weight may be selected according to the shape, considering the strength, durability, workability and the like.

In addition, in FIG. 4, the occlusion bodies 21*a* to 21*c* are pressed into contact with the stamp material 22 by the weight 23, but it is also possible to replace said weight by a plate material, and to press the occlusion body into contact with the stamp material by another pressing means.

Figure 5:
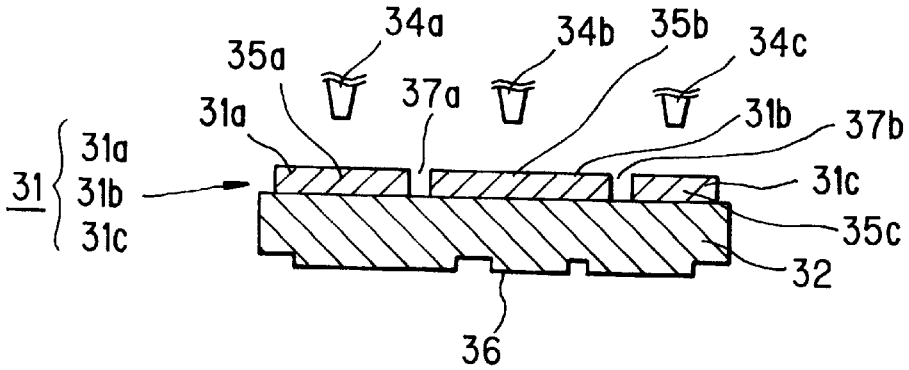
FIG. 5 is a vertical sectional view showing a third embodiment of a process for producing a self-inking stamp according to the present invention.

FIG. 5 is a vertical sectional view showing a third embodiment in accordance with the process for producing the self-inking stamp of the present invention. An occlusion body 31 is divided into 31*a* to 31*c* (dividing parts 37*a* and 37*b*), and by making this occlusion body 31 abut against a stamp material 32 from the rear side of a stamping face 36, plural kinds of ink are filled in the stamp material 32. Here, divided occlusion bodies 31*a* to 31*c* are impregnated with different kinds of ink 35*a* to 35*c*, respectively. Therefore, plural kinds of ink do not mingle with each other and by forming the shape of occlusion bodies 21*a* to 21*c* in desired shapes, the arrangement of ink filled in the stamp material 32 can be accurately controlled. With occlusion bodies in other embodiments, impregnation of ink is performed in a preprocess for making the occlusion body abut against the stamp material 32, but in this embodiment, plural kinds of ink are supplied, respectively, from ink filling ports 34*a* to 34*c* to the occlusion bodies 31*a* to 31*c* made to abut against the stamp material 32, and the plural kinds of ink are filled in the stamp material 32 through the occlusion bodies 31*a* to 31*c*.

Figure 6:
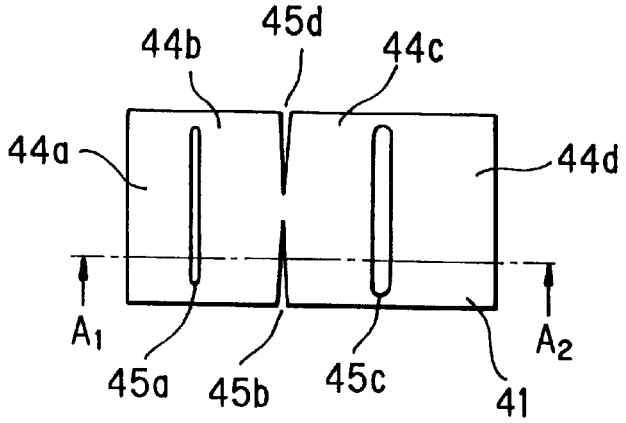
FIG. 6 is a plan view of an occlusion body used in a fourth embodiment of a process for producing a self-inking stamp according to the present invention.
Figure 7:
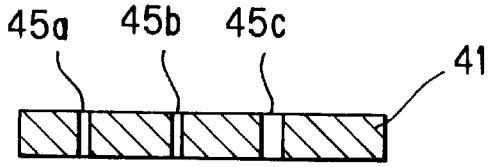
FIG. 7 is a vertical sectional view of the occlusion body in FIG. 6 taken along line $A_1$–$A_2$, in FIG. 6.

FIG. 6 and FIG. 7 show an occlusion body used in a fourth embodiment in accordance with the process for producing the self-inking stamp of the present invention, and FIG. 6 is a plan view of the occlusion body and FIG. 7, is a vertical sectional view of the occlusion body in FIG. 6, taken along line $A_1$–$A_2$ in FIG. 6. The method used at the time of the process conforms to other embodiments. An occlusion body 41 has slits 45*a* to 45*c*, the slits are elliptic slits 45*a* and 45*c* inside the occlusion body 41, having a different size, and wedge-shaped slits 45*b* and 45*d* extending close to the central part. Here, it is possible to impregnate the occlusion body 41 having slits with two to four different kinds of ink (ink 44*a* to 44*d*). These plural kinds of ink do not mingle with each other, since there are slits 45*a* to 45*d* in the occlusion body 41. Similar effect can be obtained as in the case where a divided occlusion body such as the occlusion body 1 shown in FIG. 3 is used, and an effect of suppressing mingling of colors between plural kinds of ink can be also obtained. Moreover, by forming the slits in desired shapes in the occlusion body 41, the arrangement of ink filled in the stamp material can be finely controlled. Furthermore, since the occlusion body itself is one piece, it is excellent in positioning and handling.

The width of the slit is not particularly limited, so far as plural kinds of ink do not mingle with each other, and the arrangement of ink filled in the stamp material can be finely controlled. It is properly selected from the range of, in general, not less than 0.5 mm, and preferably from 0.5 to 2.0 mm.

Figure 8:
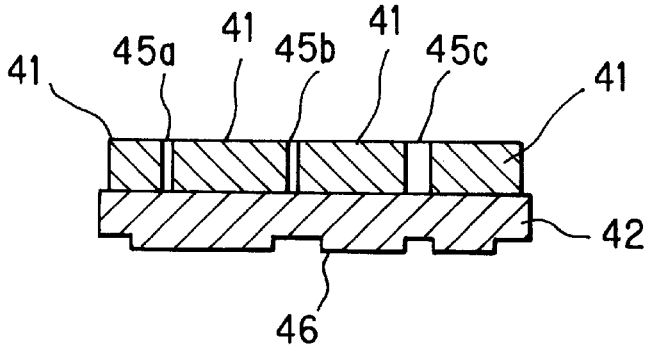
FIG. 8 is a vertical sectional view showing a fourth embodiment of a process for producing a self-inking stamp according to the present invention.

FIG. 8 is a vertical sectional view showing a fourth embodiment in accordance with the process for producing the self-inking stamp of the present invention, which uses the occlusion body 41 having slits 45*a* to 45*d* shown in FIGS. 6 and 7. By making the occlusion body 41 abut against a stamp material 42 from the rear side of a stamping face 46, plural kinds of ink are filled in the stamp material 42. As described above, since the occlusion body 41 has slits 45*a* to 45*d*, plural kinds of ink impregnated in the occlusion body 41 do not mingle with each other. Therefore, similar effect can be obtained as in the case where a divided occlusion body such as the occlusion body 1 shown in FIG. 3 is used, and an effect of suppressing mingling of colors between plural kinds of ink can be also obtained. Moreover, by forming the slits in the occlusion body 41 in desired shapes, the arrangement of ink filled in the stamp material can be finely controlled. Furthermore, since the occlusion body itself is one piece, it is excellent in positioning and handling.

Figure 9:
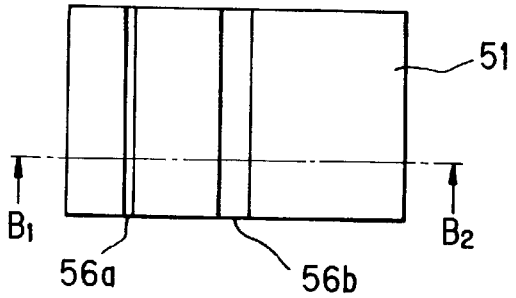
FIG. 9 is a plan view of an occlusion body used in fifth and sixth embodiments of a process for producing a self-inking stamp according to the present invention.
Figure 10:
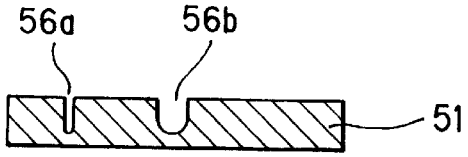
FIG. 10 is a vertical sectional view of the occlusion body in FIG. 9 taken along line $B_1$–$B_2$ in FIG. 9.

FIG. 9 and FIG. 10 show an occlusion body used in fifth and sixth embodiments in accordance with the process for producing the self-inking stamp of the present invention, and FIG. 9 shows a plan view of said occlusion body, and FIG. 10 is a vertical sectional view of the occlusion body in FIG. 9, taken along line $B_1$–$B_2$ in FIG. 9. The occlusion body 51 is provided with recess portions 56*a* and 56*b* by grooving. The usage and the effects are the same as those of the occlusion body shown in FIGS. 6 and 7.

The size of recess portions is not particularly limited. As the width of recess portions, it is not particularly limited, so far as plural kinds of ink do not mingle with each other, and the arrangement of ink filled in the stamp material can be finely controlled. It is properly selected from the range of, in general, not less than 0.5 mm, and preferably from 0.5 to 2.0 mm. Moreover, as a depth, it is preferred to have a thickness of a joint portion as small as possible, and the depth is properly selected from such a range that the size of the joint portion of, in general, not less than 0.5 mm, and preferably from 0.5 to 3.0 mm can be ensured.

Figure 11:
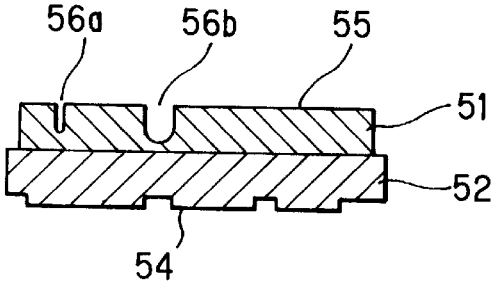
FIG. 11 is a vertical sectional view showing a fifth embodiment of a process for producing a self-inking stamp according to the present invention.
Figure 12:
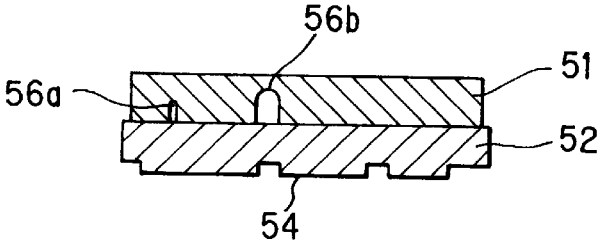
FIG. 12 is a vertical sectional view showing a sixth embodiment of a process for producing a self-inking stamp according to the present invention.

FIGS. 11 and 12 are vertical. sectional views showing fifth and sixth embodiments in according with the process for producing the self-inking stamp of the present invention, which use the occlusion body 51 provided with recess portions 56*a* and 56*b* shown in FIGS. 9 and 10. In FIG. 11, plural kinds of ink are filled in a stamp material 52, by making a rear side of a face 55 of the occlusion body 51, where the recess portions are provided, abut against a rear side of a stamping face 54 of a stamp material 52. The occlusion body 51 is provided with recess portions 56*a* and 56*b*, hence it is possible to impregnate the occlusion body 51 with two to three different kinds of ink.

In FIG. 12, plural kinds of ink are filled in the stamp material 52, by making a face 55 of the occlusion body 51, where the recess portions are provided, abut against a stamp material 52. The occlusion body 51 is provided with recess portions 56*a* and 56*b*, hence it is possible to impregnate the a occlusion body 51 with two to three different kinds of ink.

The effects and the like of the embodiments shown in FIGS. 11 and 12 are similar to those of the embodiment shown in FIG. 8.

Figure 13:
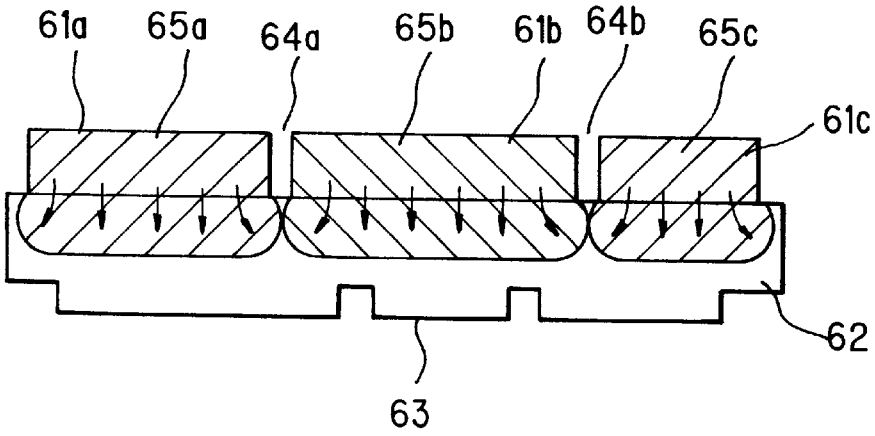
FIG. 13 shows a diagram at the time of filling ink in a vertical sectional view according to the present invention.
Figure 14:
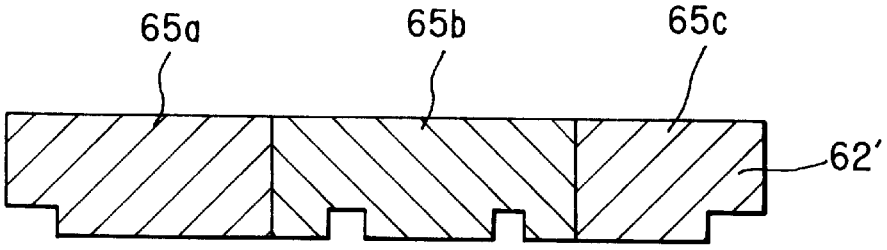
FIG. 14 shows a stamp material filled with plural kinds of ink in a vertical sectional view.

FIG. 13 shows a diagram at the time of filling ink in a vertical sectional view according to the present invention. FIG. 14 shows a stamp material filled with plural kinds of ink in a vertical sectional view. The stamp material 62 is filled with plural kinds of ink 65*a* to 65*c* contained in the occlusion bodies 61*a* to 61*c* through portions where the occlusion bodies 61*a* to 61*c* abut against the stamp material 62. On this occasion, the stamp material should be simultaneously filled with each ink 65*a* to 65*c*. The reason for this is that when the stamp material is simultaneously filled with each ink, each ink itself becomes a physical barrier in the stamp material, and each ink does not excessively penetrate out of each desired area. In other words, if the stamp material is filled with only ink 65*a*, ink 65*a* penetrates into the cells to be filled with ink 65*b*, because the cells have not yet been filled with ink 65*b*. An ordinary stamp material having a continuous porous structure is of a three-dimensional network structure, and the cells of the a stamp material are connected with other cells in all directions. The above-mentioned "simultaneously" means that filling of a portion of the stamp material with a kind of ink starts before the contiguous portion thereof has been fully filled with another kind of ink.

Thus, as a result, a stamp material 62' shown in FIG. 14 filled with plural kinds of ink can be obtained. In addition, the ink contained in the occlusion bodies 61*a* and 61*c* may be the same kind of ink.

Figure 15:
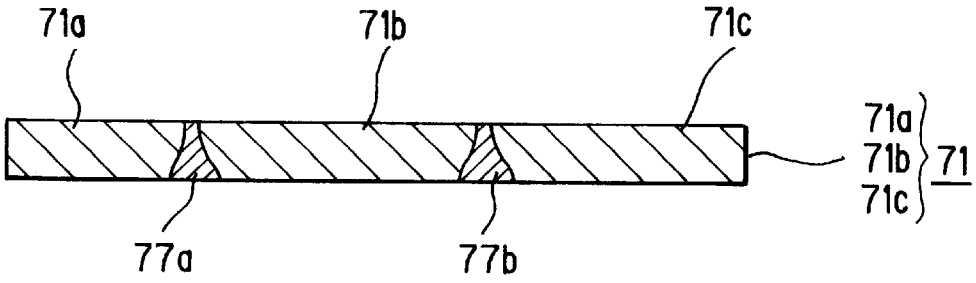
FIG. 15 is a vertical sectional view of an occlusion body used in the embodiments of the present invention.

FIG. 15 is a vertical sectional view of an occlusion body used in the embodiments of the present invention. In the occlusion body, there are disposed fillers 77*a* and 77*b* for suppressing mingling of two or more kinds of ink having different functions. In this embodiment, as a physical barriers and/or an isolation part which suppresses or inhibits mingling of said inks, an occlusion body in which a filler and the like is disposed may be used to attain the object of the present invention. In addition, as the filler, any filler which can suppress mingling of two or more kinds of ink may be used.

Figure 16:
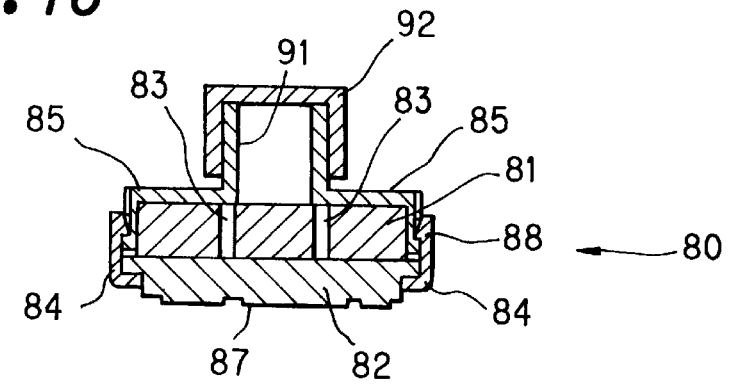
FIG. 16 is a vertical sectional view showing an embodiment of a self-inking stamp according to the present invention.
Figure 17:
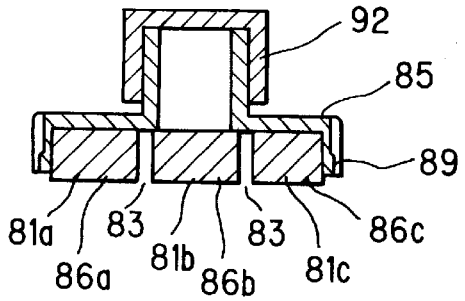
FIG. 17 is an exploded vertical sectional view of the occlusion body portion in FIG. 16.
Figure 18:
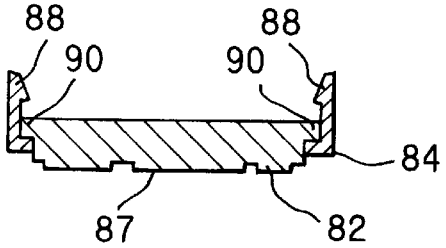
FIG. 18 is an exploded vertical sectional view of the stamp material portion in FIG. 16.
Figure 19:
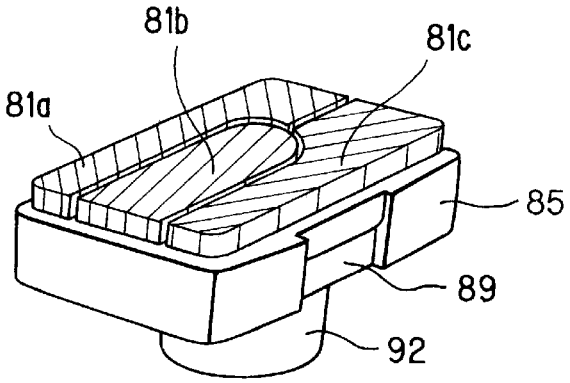
FIG. 19 is an oblique view of FIG. 17, seen from a face where the occlusion body abuts against the stamp material.

FIGS. 16 to 19 show an embodiment in accordance with the self-inking stamp of the present invention, and FIG. 16 is a vertical sectional view of the self-inking stamp, FIG. 17 is an exploded vertical sectional view of the occlusion body portion in FIG. 16, FIG. 18 is an exploded vertical sectional view of the stamp material portion in FIG. 16, and FIG. 19 is an oblique view of FIG. 17, seen from a face where the occlusion body abuts against the stamp material.

As shown in FIGS. 16 to 19, with respect to a self-inking stamp 80, a stamp material 82 is filled with plural kinds of ink from an occlusion body 81, by making the occlusion body 81 abut against the stamp material 82 from the rear side of a stamping face 87. The stamp material 82 is provided with a projection (a projecting portion 90 in FIG. 18) on the side face to secure the occlusion body 81 on the stamp material 82. To this projecting portion 90 is detachably attached a holder 84. In the vicinity of the top end of the holder 84, a protrusion portion 88 is disposed toward inside. The occlusion body 81 is divided into 81*a* to 81*c* (dividing parts 83). A base plate 85 is disposed on the occlusion body 81 so as to enclose the occlusion body 81. The base plate 85 has a stepped recess 89 disposed in the central part on the side face of the occlusion body 81. By engaging the holder 84 with the stepped recess 89, the occlusion body 81 is made to abut against the stamp material 82. Moreover, the base plate 85 is provided with a cylindrical portion 91 on the rear side of a face where the occlusion body 81 is made to abut against the stamp material 82, and the cylindrical portion 91 is attached to a handle 92 such as is done with a bottle cap.

As described above, by making the occlusion body 81 abut against the stamp material 82, the occlusion body 81 can be freely attached or detached to/from the stamp material 82, and the divided occlusion bodies 81*a* to 81*c* are impregnated with at least three different kinds of ink (86*a* to 86*c*), respectively. Therefore, these plural kinds of ink do not mingle with each other, and by forming the shapes of occlusion bodies 81*a* to 81*c* in desired shapes, the arrangement of ink filled in the stamp material can be accurately controlled.

As described above, the self-inking stamp obtained by the process of the present invention can make an imprint comprising plural kinds of ink with a single stamping, by filling plural kinds of ink in one stamp material. It has also distinguished effects that there is no break due to a boundary in the imprint comprising plural kinds of ink, showing a very natural impression, and that the filling area of plural kinds of ink is faithful to a predetermined area.

In the present invention, as a reason why more than two kinds of ink having different functions do not mix in the stamp material or in the occlusion body, for example, a mechanism described below can be considered, but the present invention is not limited thereto.

In the present invention, a stamp material, and the occlusion body having a continuous porous structure in a form of a sponge, and the occlusion body having a continuous porous structure in a form of a sponge or in a form of a felt is used. Since the continuous porous structure is formed with small cells aggregated, the stamp material and the occlusion body are continuously porous in which small cells aggregate. Hence, the inks filled in the stamp material and the occlusion body are held in each cell, thereby movement of inks are suppressed, and mingling of the plural kinds of ink between respective cells is hardly caused.

Moreover, even if two or more kinds of ink enter the same cell, since the function of each ink in the cell is different from each other, two or more kinds of ink do not always mingle in an instant.

Furthermore, it is possible to effectively suppress mingling of two or more kinds of ink, by using means described below:

(1) making the viscosity of ink high;

(2) imparting structural viscosity to the ink;

(3) making the particle size of coloring materials large, for example, using a pigment as the coloring materials; and (4) using a vehicle in each ink for filling having no solubility with each other.

Furthermore, when a user fills the self-inking stamp produced by the process of the present invention with ink, since a physical barrier and/or an isolation part is provided in the occlusion body, the only thing that has to be done is to make a desired occlusion body abut against a stamp material which is not divided, thereby the stamp material is easily filled with ink while preventing two or more kinds of ink from mingling with each other.

Moreover, if the ink holding force of the occlusion body is set to be weaker than that of the stamp material, the ink held in the occlusion body is sucked in and moves toward the stamp material, hence the feed speed of the ink to the stamping face or the amount to be supplied can be efficiently adjusted.

In the above case, the size of the continuous porous structure of the stamp material and the occlusion body, that is, the size of the cell is such that the size of the occlusion body is larger than that of the stamp material.

The ink filled in each cell is suppressed from fluctuating (that is, fluidity is suppressed) by the size of the cell. Therefore, in a large cell in the occlusion body, the ink flows more easily than in a small cell in the stamp material. As in the present invention, by providing a physical barrier and/or an isolation part which suppresses or inhibits mingling of two or more kinds of ink in the occlusion body, such a distinguished effect that mingling of ink can be effectively prevented can be exerted.

The above-mentioned effect can also effectively suppresses or inhibits mingling of plural kinds of ink in an occlusion body even though supplying ink to the stamp material and filling the occlusion body itself with ink are often repeated in the occlusion body, at a step of filling a stamp material with ink (a step of manufacturing a self-inking stamp).

EXAMPLE

The present invention will now be described in detail by way of example which is only illustrative of the invention and do not impose any limitation upon the invention.

Example 1

After dividing PVF [poly(vinyl formal), manufactured by Kanebo Ltd.; a trade name "Kanebo Sponge Sheet Belleater"], which was used as an occlusion body, so that the space between respective occlusion bodies becomes 0.5 mm, and impregnating them with a plurality of ink, they were made abut against a foamed PE sheet (polyethylene sheet which is a stamp material sheet used in "Stamprin", a trade name, manufactured by Mitsubishi Pencils Co., Ltd.) having a thickness of 1.6 mm, which was used as a stamp material to be filled with ink, and an intended self-inking stamp capable of producing an excellent imprint was obtained.

As described above, the self-inking stamp as provided by the present invention, including the self-inking stamp produced by the process of the present invention exert distinguished effects that by filling plural kinds of ink in one stamp material, an imprint comprising plural kinds of ink can be formed by a single stamping, that there is no break due to a boundary in the imprint comprising plural kinds of ink, showing a very natural impression, and that the filling area of plural kinds of ink is faithful to a predetermined area.

What is claimed is:

1. A process for producing a self-inking stamp capable of stamping repeatedly, the process comprising:

(i) providing a self-inking stamp comprising (a) a stamp material having a continuous porous structure and a stamping face and (b) an occlusion body having a continuous porous structure adjacent the side of the stamp material opposite the stamping face, the occlusion body having a physical barrier, an isolation part, or both which suppresses or inhibits mingling of two or more kinds of ink; and (ii) impregnating two or more kinds of ink into the occlusion body so as to infiltrate two or more kinds of ink into the stamp material, wherein the ink holding force of the occlusion body is less than that of the stamp material.

2. The process for producing a self-inking stamp according to claim 1, wherein the occlusion body having a continuous porous structure is divided.

3. The process for producing a self-inking stamp according to claim 2, wherein each divided occlusion body is separated from an adjacent occlusion body by 0.5 mm or more.

4. The process for producing a self-inking stamp according to claim 1, wherein the occlusion body having a continuous porous structure is provided with a slit.

5. The process for producing a self-inking stamp according to claim 1, wherein the occlusion body having a continuous porous structure is provided with a recess portion.

6. The process for producing a self-inking stamp according to claim 1, wherein a filler is disposed in the occlusion body having a continuous porous structure.

7. A self-inking stamp produced by the process of claim 1.

8. A self-inking stamp comprising (a) a stamp material having a continuous porous structure and a stamping face and (b) an occlusion body having a continuous porous structure adjacent the side of the stamp material opposite the stamping face, the occlusion body having a physical barrier, an isolation part, or both which suppresses or inhibits mingling of two or more kinds of ink, the self-inking stamp capable of stamping repeatedly by impregnating two or more kinds ink into the occlusion body so as to infiltrate two or more kinds of ink into the stamp material, wherein the ink holding force of the occlusion body is less than that of the stamp material.

9. The self-inking stamp according to claim 8, wherein the occlusion body having a continuous porous structure is divided.

10. The self-inking stamp according to claim 9, wherein each divided occlusion body is separated from an adjacent occlusion body by 0.5 mm or more.

11. The self-inking stamp according to claim 8, wherein the occlusion body having a continuous porous structure is provided with a slit.

12. The self-inking stamp according to claim 8, wherein the occlusion body having a continuous porous structure is provided with a recess portion.

13. The self-inking stamp according to claim 8, wherein a filler is disposed in the occlusion body having a continuous porous structure.

* * * * *